US007124663B1

(12) United States Patent
Wang

(10) Patent No.: US 7,124,663 B1
(45) Date of Patent: Oct. 24, 2006

(54) BOTTLE OPENER

(76) Inventor: Huang-Lin Wang, No. 9, Nan-Chin 1st St., Fengshan (TW)

( * ) Notice: Subject to any disclaimer, the term of this patent is extended or adjusted under 35 U.S.C. 154(b) by 0 days.

(21) Appl. No.: 11/161,102

(22) Filed: Jul. 22, 2005

(51) Int. Cl.
*B67B 7/16* (2006.01)

(52) U.S. Cl. ..... 81/3.56; 81/3.44

(58) Field of Classification Search ..... 81/3.55, 81/3.56, 3.57, 3.07, 3.4, 3.44
See application file for complete search history.

(56) References Cited

U.S. PATENT DOCUMENTS

| | | | | | |
|---|---|---|---|---|---|
| 1,342,848 | A * | 6/1920 | Johnson | 81/3.44 |
| 2,407,793 | A * | 9/1946 | Mitchell | 81/3.56 |
| 2,431,833 | A * | 12/1947 | Simpson | 81/3.44 |
| 2,440,485 | A * | 4/1948 | Ranseen | 81/3.56 |
| 2,625,847 | A * | 1/1953 | Frazier | 81/3.56 |
| 2,651,957 | A * | 9/1953 | Phillips | 81/3.36 |
| 2,710,551 | A * | 6/1955 | Walters | 81/3.56 |
| 2,779,224 | A * | 1/1957 | Lee | 81/3.44 |
| 2,924,133 | A * | 2/1960 | Marulli | 81/3.08 |
| 5,295,419 | A * | 3/1994 | Denning | 81/3.37 |
| 6,544,030 | B1 | 4/2003 | Evers | 431/253 |
| 6,679,138 | B1 | 1/2004 | Battles et al. | 81/3.44 |
| 6,761,088 | B1 | 7/2004 | Sasso | 81/3.57 |
| 6,775,869 | B1 | 8/2004 | Cohen | 7/151 |
| 2003/0150296 | A1 * | 8/2003 | Vandergaw | 81/3.4 |

* cited by examiner

*Primary Examiner*—Debra S Meislin
(74) *Attorney, Agent, or Firm*—Alan D. Kamrath; Nikolai & Mersereau, P.A.

(57) ABSTRACT

A bottle opener includes a first member and a second member. The first member includes an engaging section. The second member comprises a cap-removal portion and a grip portion. One of the first member and the second member includes two slots defined therein. An axle is slidably extended through the slots for pivotally connecting the first member and the second member. The engaging section engages with a portion of a circumferential end edge of a cap of a bottle to be opened. The grip portion of the second member is movable relative to the cap to a position for engaging with another portion of the circumferential end edge of the cap opposite to the portion of the circumferential end edge of the cap, thereby allowing removal of the cap.

6 Claims, 4 Drawing Sheets

BOTTLE OPENER

BACKGROUND OF THE INVENTION

1. Field of the Invention

The present invention relates to a bottle opener. In particular, the present invention relates to a bottle opener for removing a cap from a bottle.

2. Description of Related Art

Various bottle openers with different design ideas have been developed. A typical bottle opener includes a central opening with a protruded portion formed on a perimeter delimiting the central opening. However, removal of a cap from a bottle to be opened may not be smoothly achieved, as the opener is apt to slip from the cap. Further, the opener is in point contact with the cap during the removal operation such that the user must hold the opener at a position adjacent to the cap, resulting in a short arm of force. Thus, a relatively large force must be applied for removing the cap from the bottle along a direction toward the cap. As a result, the user risks injury by the teeth of the cap when the fingers come into contact with the cap during the removal operation.

OBJECTS OF THE INVENTION

An object of the present invention is to provide a bottle opener that allows stable cap-removing operation.

Another object of the present invention is to provide a bottle opener with improved safety during removal of a cap from a bottle.

A further object of the present invention is to provide a bottle opener with a simple structure while allowing stable cap-removing operation.

SUMMARY OF THE INVENTION

A bottle opener in accordance with the present invention comprises a first member and a second member. The first member comprises an engaging section. The second member comprises a cap-removal portion and a grip portion. One of the first member and the second member comprises two slots defined therein. An axle is slidably extended through the slots.

The engaging section engages with a portion of a circumferential end edge of a cap of a bottle to be opened. The first member and the second member are pivotally connected by the axle. When pressing the axle against a top face of the cap, the grip portion of the second member is movable relative to the cap to a position for the cap-removal portion of the second member to engage with another portion of the circumferential end edge of the cap opposite to the portion of the circumferential end edge of the cap, thereby allowing removal of the cap.

In an alternative arrangement, the bottle opener comprises two connection ends slidably received in the slots respectively, and the axle comprises two ends pivotally connected to the connection ends respectively.

The cap-removal portion of the second member may be hooked to provide an enhanced engaging effect.

In an embodiment of the invention, the cap-removal portion and the grip portion of the second member are on different sides of the axle.

In another embodiment of the invention, the cap-removal portion and the grip portion of the second member are on the same side of the axle.

The grip portion of the second member may be telescopic for easy carriage and storage purposes.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
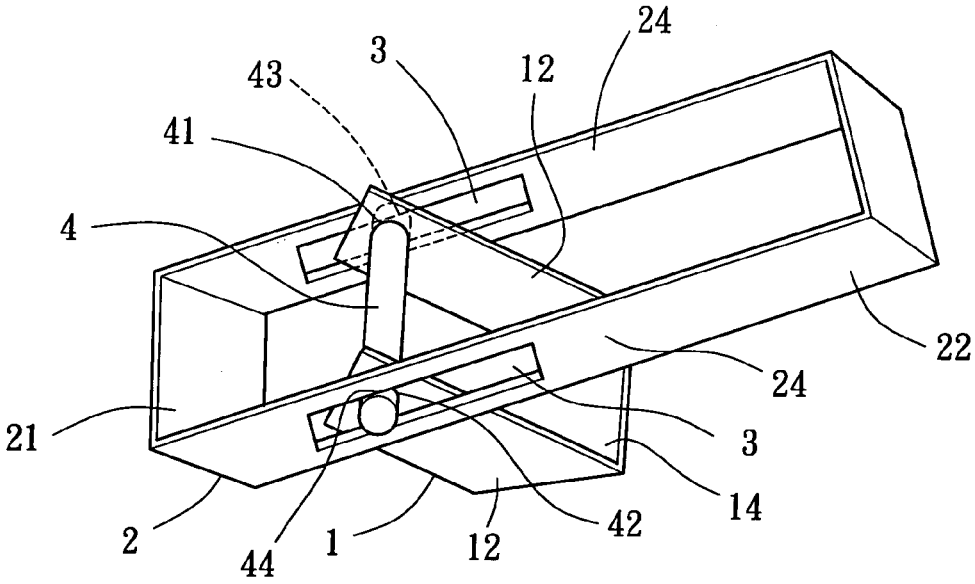
FIG. 1 is a perspective view of a bottle opener in accordance with the present invention.
Figure 5:
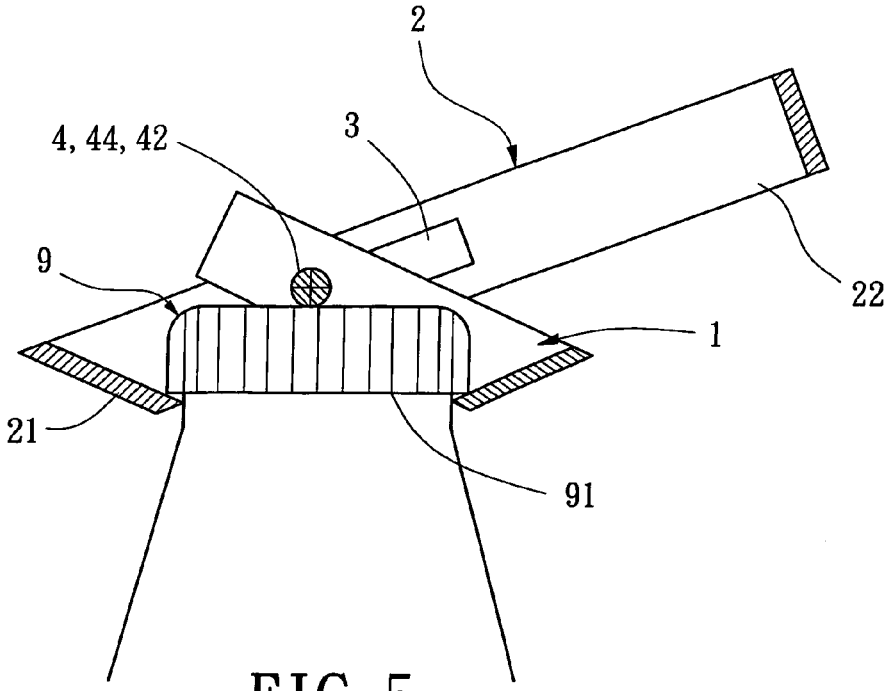
FIG. 5 is a sectional view of the bottle opener in FIG. 4.

Referring to FIG. 1, a bottle opener in accordance with the present invention comprises a first member 1 and a second member 2 that are made of metal materials (such as iron) more rigid than a cap 9 (FIG. 5) of a bottle (not labeled) to be opened. In the illustrated embodiment, the first member 1 is substantially U-shaped and comprises two arms 12 and an engaging section 14 between the arms 12. Aligned holes 41 and 42 are defined in the arms 12, and an axle 4 is extended through the holes 41 and 42.

The second member 2 in the illustrated embodiment is substantially rectangular and comprises a cap-removal portion 21, a grip portion 22, and two longitudinal sides 24 having aligned slots 3. In an alternative arrangement, the slots 3 are defined in the first member 1. Although not specifically shown, the grip portion 22 of the second member 2 may be telescopic to allow adjustment of the overall length of the second member 2 for easy carriage and storage purposes.

Two ends of the axle 4 are slidably received in the slots 3, respectively. In this embodiment, two connection ends 43 and 44 are slidably received in the slots 3 respectively, and the ends of the axle 4 are pivotally connected to the connection ends 43 and 44 respectively. Alternatively, the axle 4 is in the form of a single shaft or a pin, with two ends of the shaft or pin slidably received in the slots 3 respectively.

Figure 2:
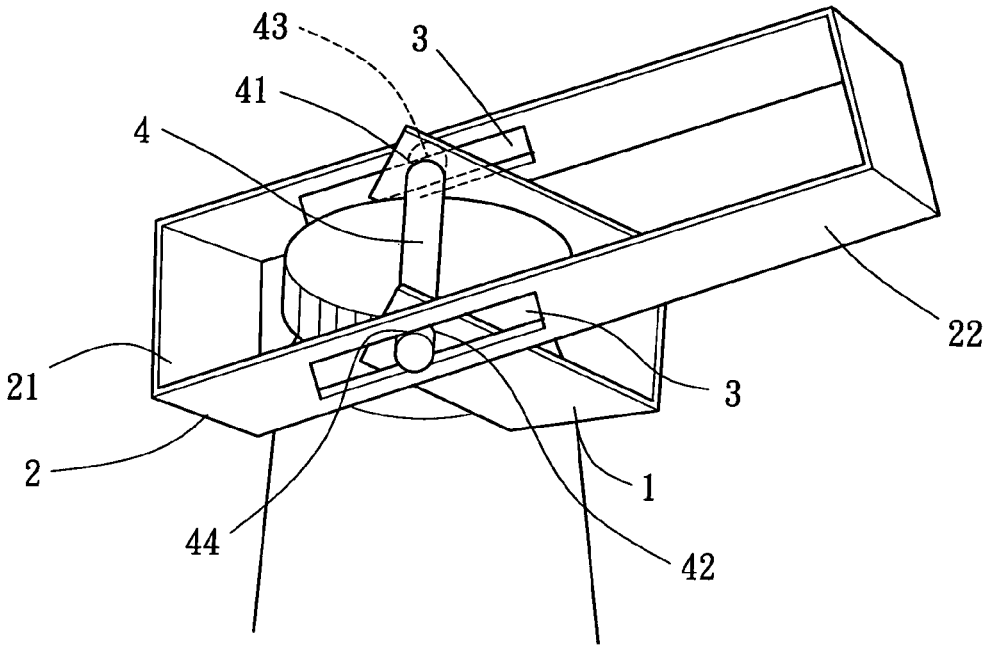
FIG. 2 is a perspective view illustrating use of the bottle opener for removing a cap from a bottle.

In use, the bottle opener is placed on the cap 9 of a bottle to be opened, with the engaging section 14 of the first member 1 engaging with a portion of a circumferential end edge 91 of the cap 9, as shown in FIG. 2. The user then engages the axle 4 with a top face of the cap 9. Thus, the first member 1 is retained on the cap 9.

Figure 3:
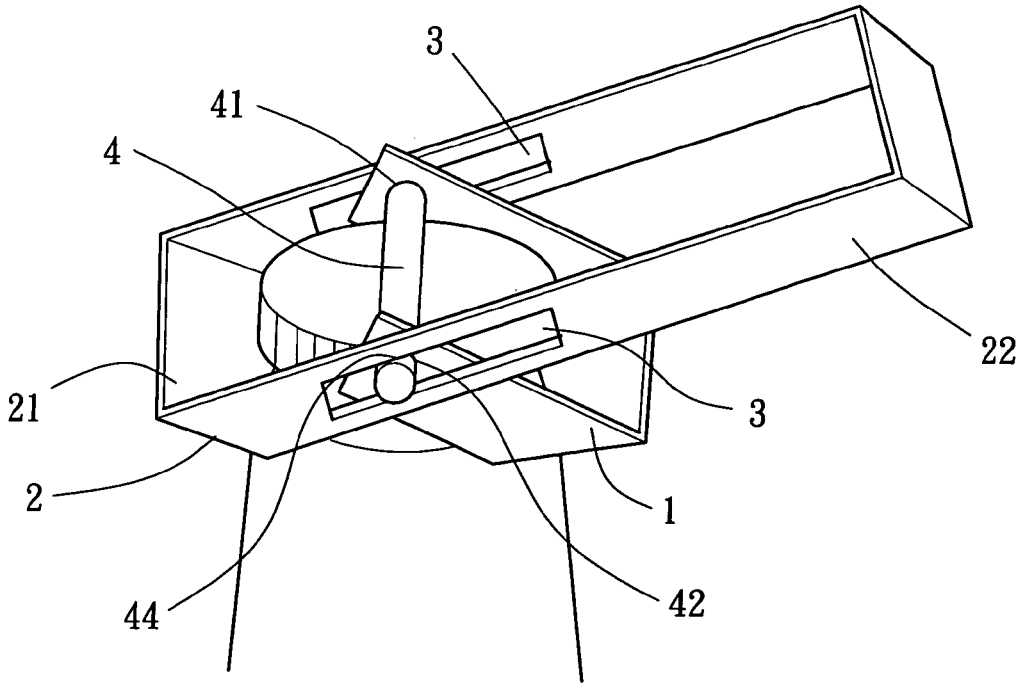
FIG. 3 is a perspective view similar to FIG. 2, illustrating a transition position of the bottle opener.
Figure 4:
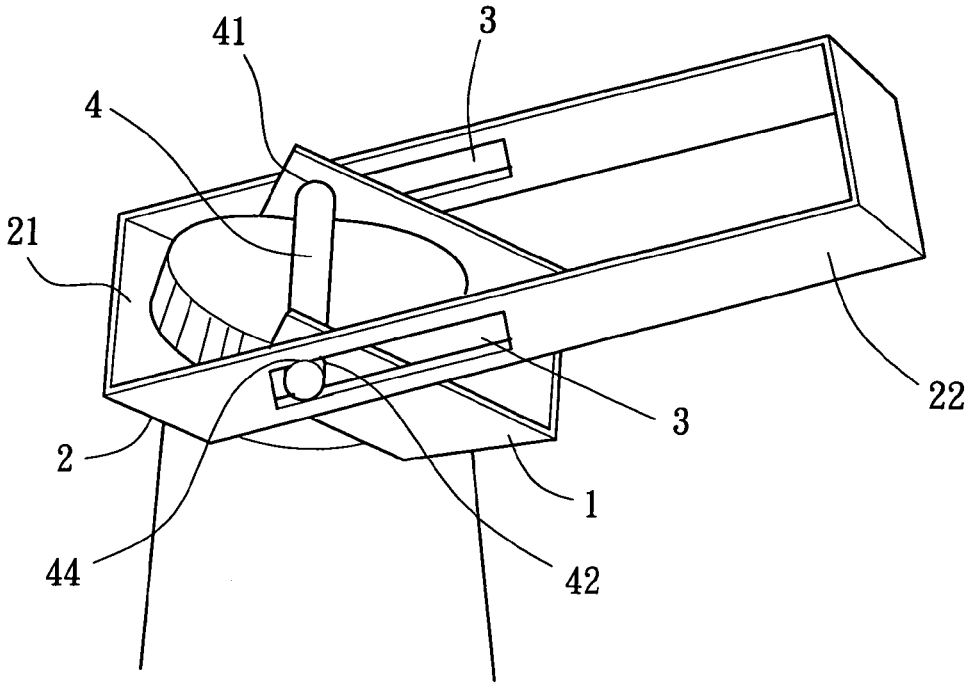
FIG. 4 is a perspective view similar to FIG. 3, wherein the bottle opener is in a position ready for removing the cap of the bottle.

Next, the second member 2 is moved relative to the first member 1 until the cap-removal portion 21 of the second member 2 engaging with another portion of the circumferential end edge 91 of the cap 9 that is substantially diametrically opposite to the portion engaged against by the engaging section 14 of the first member 1. Thus, the circumferential end edge 91 of the cap 9 is engaged against by the cap-removal portion 21 of the second member 2, and an outer circumference of the bottle adjacent to the circumferential end edge 91 of the cap 9 is engaged against by the engaging section 14 of the first member 1, best shown in FIGS. 4 and 5. FIG. 3 shows a transition position of the bottle opener. When the bottle opener is in a position shown in FIG. 5, the user may apply a downward force to the grip portion 22 to remove the cap 9 from the bottle by the cap-removal portion 21 engaging with the circumferential end edge 91 of the cap 9. The cap-removal operation is easier and more stable as compared to conventional openers.

Figure 6:
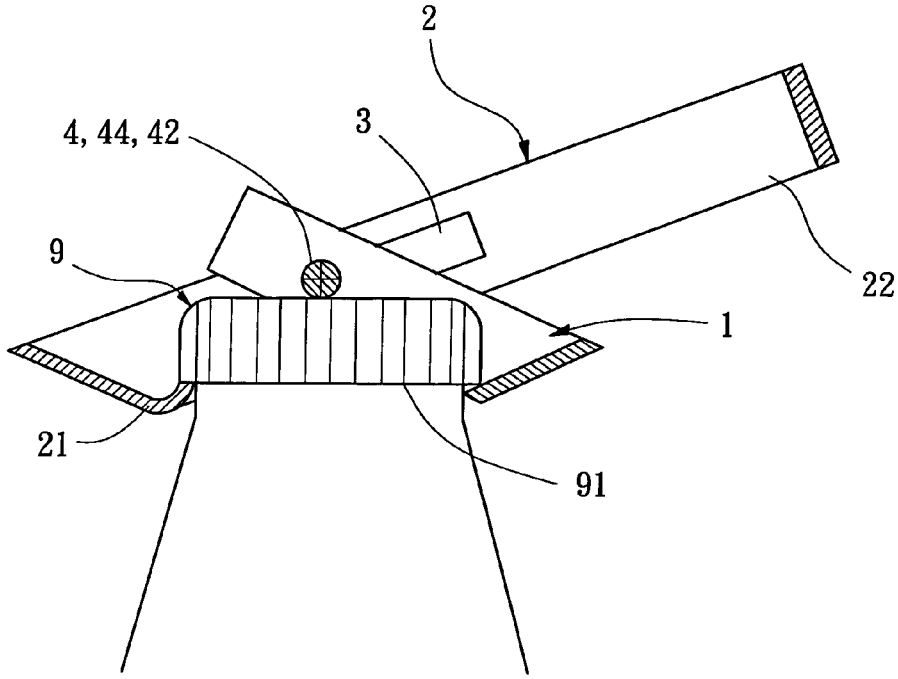
FIG. 6 is a sectional view similar to FIG. 5, illustrating a modified embodiment of the bottle opener in accordance with the present invention.

FIG. 6 illustrates a modified embodiment of the invention, wherein the cap-removal portion 21 of the second member 2 includes hooked for enhancing the engaging effect against the circumferential end edge 91 of the cap 9. The cap-removal operation is easier and more stable as compared to conventional openers.

Figure 7:
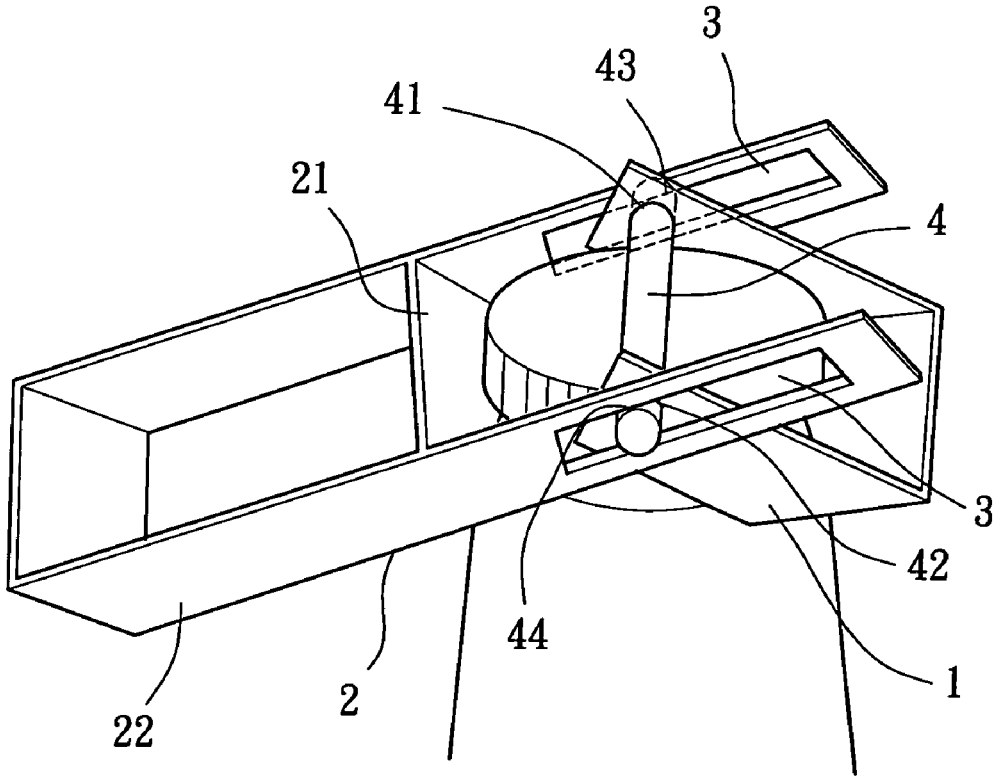
FIG. 7 is a perspective view illustrating another modified embodiment of the bottle opener in accordance with the present invention.

FIG. 7 illustrates another modified embodiment of the invention, wherein the cap-removal portion 21 and the grip portion 22 of the second member 2 in this embodiment are on the same side of the first member 1 whereas the cap-removal portion 21 and the grip portion 22 of the second member 2 in the previous embodiments are on different sides of the first member 1. Similar to the first embodiment, the cap-removal portion 22 of the second member 2 and the engaging section 14 of the first member 1 engage with two diametrically opposed portions of the circumferential end edge 91 of the cap 9.

As apparent from the foregoing, the problem of easy slipping and the risk of injury to the user existing in conventional bottle openers are avoided by the bottle opener in accordance with the present invention. The bottle opener in accordance with the present invention is not complicated and can be operated easily to allow easy cap removal.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A bottle opener comprising:

a first member comprising an engaging section;

a second member comprising a cap-removal portion and a grip portion;

one of the first member and the second member comprising two slots defined therein; and an axle slidably extending through the slots;

the engaging section being adapted to engage with a portion of a circumferential end edge of a cap of a bottle;

the first member and the second member being pivotally connected by the axle; and the grip portion of the second member being movable relative to the cap to a position for the cap-removal portion of the second member to engage with another portion of the circumferential end edge of the cap opposite to the portion of the circumferential end edge of the cap, thereby allowing removal of the cap.

2. The bottle opener as claimed in claim 1, wherein the axle is constructed from a single shaft or a pin.

3. The bottle opener as claimed in claim 1, wherein the cap-removal portion of the second member is hooked.

4. The bottle opener as claimed in claim 1, wherein the cap-removal portion and the grip portion of the second member are on different sides of the axle.

5. The bottle opener as claimed in claim 1, wherein the cap-removal portion and the grip portion of the second member are on the same side of the axle.

6. The bottle opener as claimed in claim 1, wherein the grip portion of the second member is telescopic.

* * * * *